US005148617A

United States Patent [19]

Feller et al.

[11] Patent Number: 5,148,617

[45] Date of Patent: Sep. 22, 1992

[54] WING PLOW MOUNTING SUPPORT FRAMEWORK

[75] Inventors: Richard Feller, Monroe, Wis.; Vincent Alongi, McConnell, Ill.

[73] Assignee: Monroe Truck Equipment, Inc., Monroe, Wis.

[21] Appl. No.: 720,640

[22] Filed: Jun. 25, 1991

[51] Int. Cl.[5] ..... E01H 5/06

[52] U.S. Cl. ..... 37/281; 37/231; 37/274; 172/739

[58] Field of Search ..... 172/739; 37/231, 266, 37/279, 281

[56] References Cited

U.S. PATENT DOCUMENTS 2,333,361 11/1943 Churchill ..... 37/279 X
3,376,946 4/1968 Paulson ..... 37/231 X
4,596,081 6/1986 De Billy et al. ..... 37/281

*Primary Examiner*—Dennis L. Taylor
*Assistant Examiner*—Arlen L. Olsen
*Attorney, Agent, or Firm*—Kajane McManus

[57] ABSTRACT

The support framework for supported mounting of a mounting arm of a wing plow blade includes two mirror image sections, one mounted on each side wall of a forward plow frame. Each section includes a substantially squared peripheral lip within which a first and second plate are contiguously seated in side by side manner, each securing the position of the other within the lip. The first plate is rotatable about a hinge to a position outside the lip, allowing the second plate, which is attached to the side wall of the forward plow frame by a pivot, to pivot forwardly and rearwardly within the confines of the lip, allowing for tiltability of a vertical mounting post of the wing plow which is engaged to the second plate by means of the wing plow mounting are extending therethrough.

19 Claims, 3 Drawing Sheets

WING PLOW MOUNTING SUPPORT FRAMEWORK

BACKGROUND OF THE INVENTION

The present invention relates to a support framework for supported mounting of a wing plow to a front plow frame of a vehicle. More particularly, the framework includes structure which will maintain the wing plow at a desired upright position during transport and use thereof, the structure being manipulatable to allow for tilting of the wing plow and vertical mounting post thereof to allow access to the engine compartment of the vehicle to which it is attached.

PRIOR ART

Heretofore, the wing plow of a heavy duty plowing vehicle has been engaged to the plow frame for the forward plow blade by sliding a mounting arm of the wing plow blade through a pair of aligned openings provided therefor in side walls of the forward plow frame.

Each opening is configured to allow for vertical positioning as well as for a downward and forward tilt of the arm and hence of an upright mounting post along which the wing plow rides vertically. This upright mounting post is typically located immediately forward of a truck hood, which usually is forwardly tiltable to allow for maintenance of the vehicle engine, and, when vertical, the post interferes with forward tiltability of the hood.

The mounting post and mounting arm are engaged to one another and are simultaneously forwardly pivotable about a pivot for the wing plow which is rearwardly subjacent the opening the side wall of the front plow frame, with such free pivoting of the arm and post within the opening creating a great deal of stress on the pivot.

As will be defined in greater detail hereinafter, the framework of the present invention provides means for locking the mounting arm and mounting post in an upright position thereof when the wing plow blade is in use or being transported while allowing for release of the mounting arm and mounting post from this locked position for tiltability during periods when the vehicle engine needs to be accessed by forward tilt of the truck hood.

SUMMARY OF THE INVENTION

According to the invention there is provided a support framework for supported mounting of a wing plow mounting arm and engaged vertical mounting post to side walls of a forward plow frame of a vehicle in a manner where the mounting arm and post are held steady during transport and use of the wing plow while allowing for pivoting of the mounting arm when vehicle engine access is desired. The support framework comprises two mirror image sections, one mounted on each side wall of the forward plow frame, and each section includes a substantially squared peripheral lip within which are seated contiguously, in side by side manner, a first plate hingedly engaged to the lip and pivotable about the hinge to a position not seated within the peripheral lip and a second plate which is secured to the wing plow mounting arm and to the side wall of the forward plow frame, the second plate being forwardly rotatable about a subjacent rear pivot point when the first plate is not seated adjacently within the lip, the two plates abutting one another and filling the squared space defined by the lip when they are both within the confines thereof, securing the position of the second plate against rotation from an upright position thereof.

BRIEF DESCRIPTION OF THE DRAWINGS

Other objects and advantages of the invention will become more apparent upon perusal of the detailed description thereof and upon inspection of the drawings in which.

DESCRIPTION OF THE PREFERRED EMBODIMENT

Figure 3:
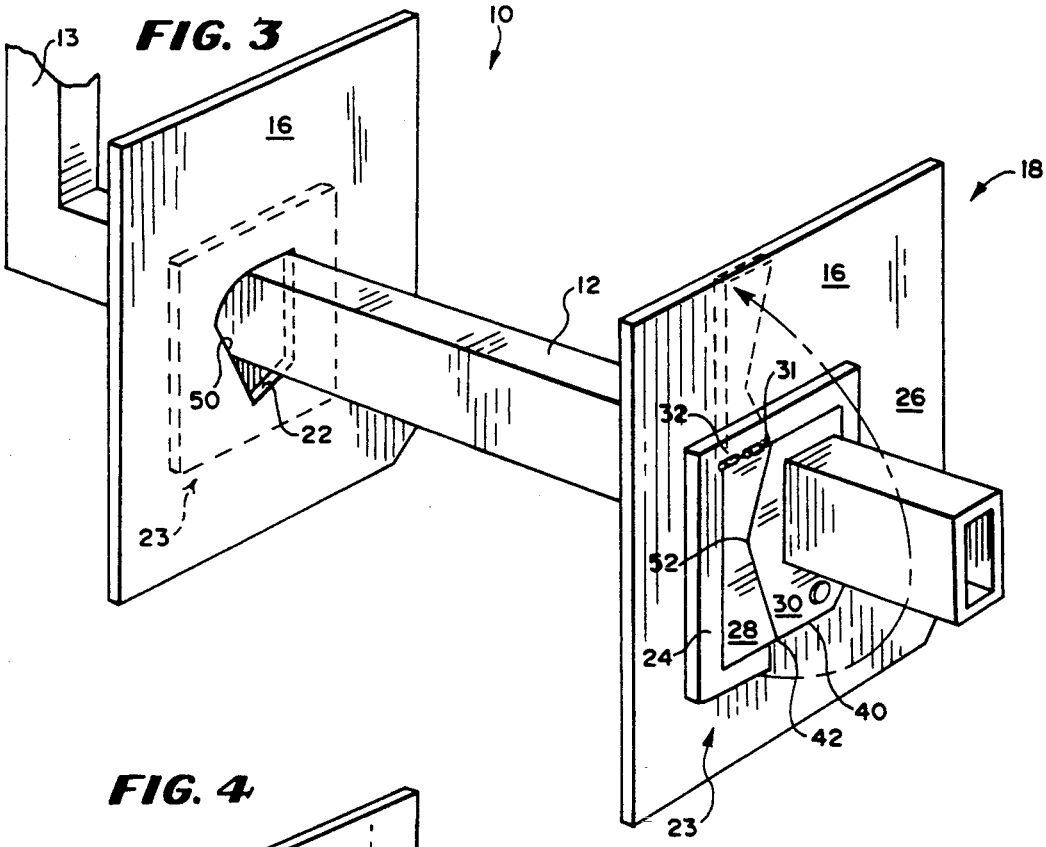
FIG. 3 is an enlarged perspective view of the mounting arm and mounting post of the wing plow assembly mounted to the framework and shows the framework in a locked position thereof.

Referring now to the drawings in greater detail, there is illustrated therein a support framework 10 for supported mounting a mounting arm 12 and engaged vertical mounting post 13 of a wing plow 14 to side walls 16 of a forward plow frame 18. As shown, parallel side walls 16 of the forward plow frame 18 extend forwardly from a vehicle 20 to which the wing plow 14 is to be mounted. Each side wall 16 has an opening 22 therein aligned with the other (FIGS. 3 and 4) into and through which the mounting arm 12 of the wing plow 14 extends, the arm 12 terminating at a point laterally outwardly of the side wall 16 opposite that which is adjacent the wing plow 14.

It will be understood that each side wall 16 includes a support framework section 23 thereon, which is a mirror image of that on the opposite side wall 16.

The wing plow 14 must be maintained in an upright position during plowing as well as during transport thereof.

At times however, such as when engine maintenance of the vehicle 20 is required, the wing plow mounting arm 12 and engaged vertical post 13 must be forwardly tiltable to allow access to the engine compartment below the vehicle hood. Such accessibility is restricted by the vertical mounting post 13 along which the wing plow 14 vertically travels.

This vertical mounting post 13 is seated just forward of a nose of the vehicle 20, as shown. Most heavy plowing vehicles 20 include a hood 21 which rotates forwardly to allow access to the engine compartment therebeneath and the positioning of the vertical mounting post 13 as shown does not allow for forward pivotability, of the hood 21. Thus, to provide for access to the engine by allowing tiltability to the wing plow arm 12 and vertical post 13, there is a need to provide the support framework 10 for the mounting arm 12, which allows for releasable locking of the arm 12 and post 13, while also functioning to eliminate stress on a pivot point engagement of the mounting arm 12 as will be defined in greater detail hereinafter.

As shown, each framework section 23 includes a raised peripheral lip 24 defining an approximately square area therein, the lip 24 being welded to an external surface 26 of each side wall 16 of the forward plow frame 18, framing the opening 22 in each side wall 16 in a manner as will be described in greater detail hereinafter.

Figure 1:
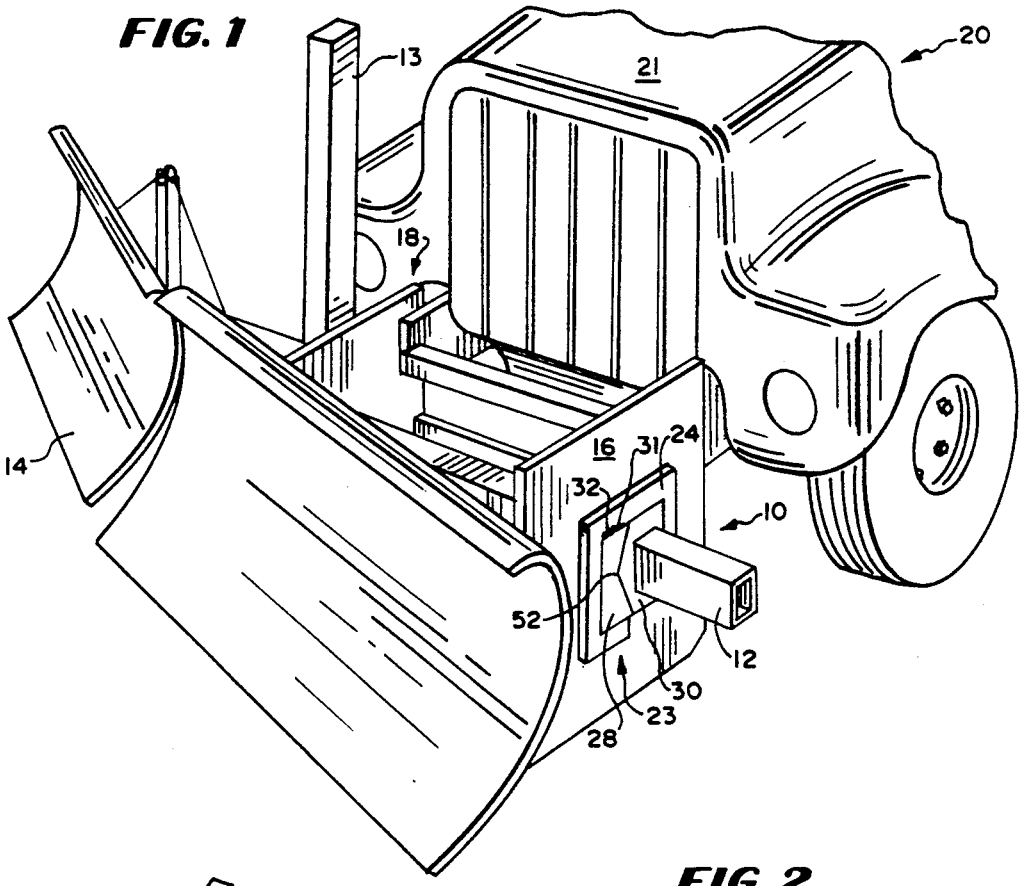
FIG. 1 is a perspective view of a vehicle mounted wing plow assembly showing a support framework of the present invention engaged to a side wall of a forward plow frame and locked in place to carry the wing plow mounting arm and vertical mounting post in an upright position thereof.

Within this lip 24 are two contiguous steel plates 28 and 30 which mesh to form a square when engaged within the lip 24 as shown in FIG. 1. When the plates 28 and 30 are seated thusly, they are locked in position by one another against movement and this is the upright position in which the plate 30 is maintained during transport and use of the wing plow 14, steadying same by securing the mounting arm 12 thereof against pivoting from this upright position.

Figure 2:
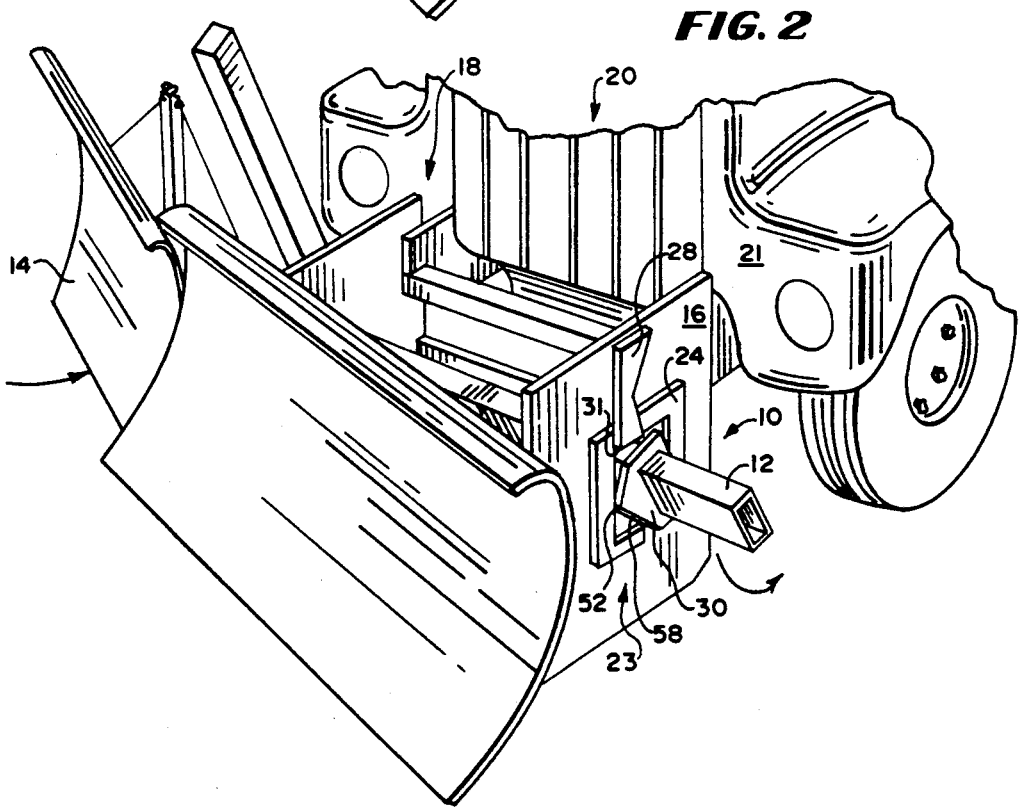
FIG. 2 is similar to FIG. 1 but shows the framework in an unlocked position thereof allowing the mounting arm and post to pivot freely.
Figure 4:
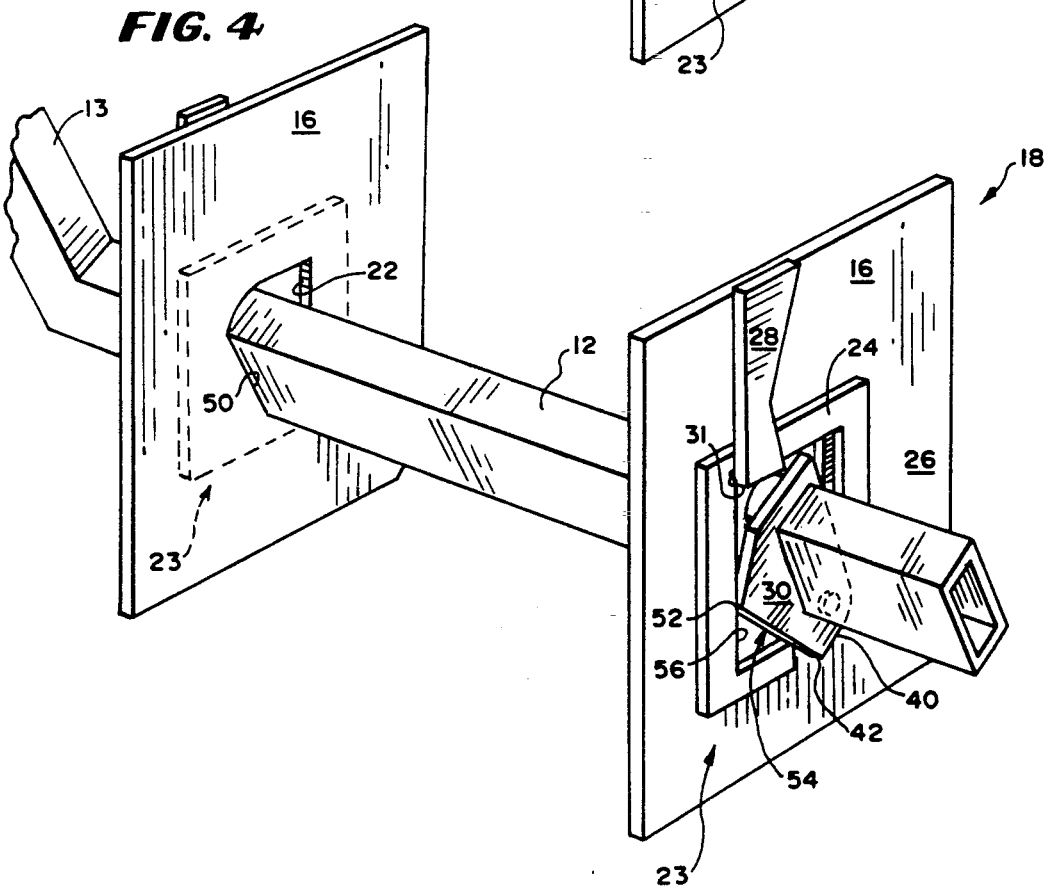
FIG. 4 is similar to FIG. 3 but shows the framework in an unlocked condition thereof and the mounting arm and mounting post pivoted forwardly.
Figure 5:
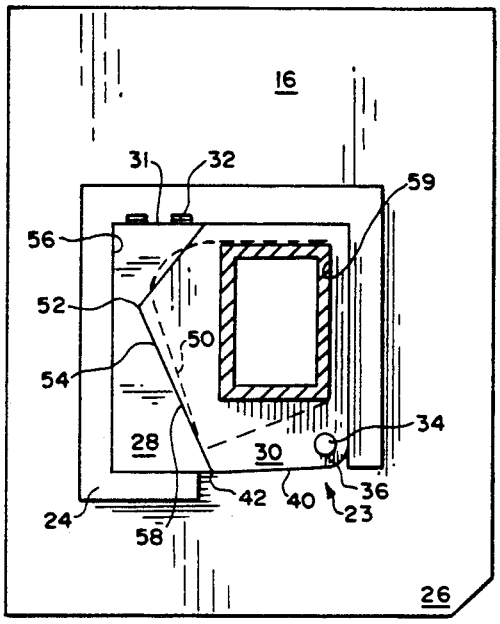
FIG. 5 is a front view of the framework in a locked condition thereof.
Figure 6:
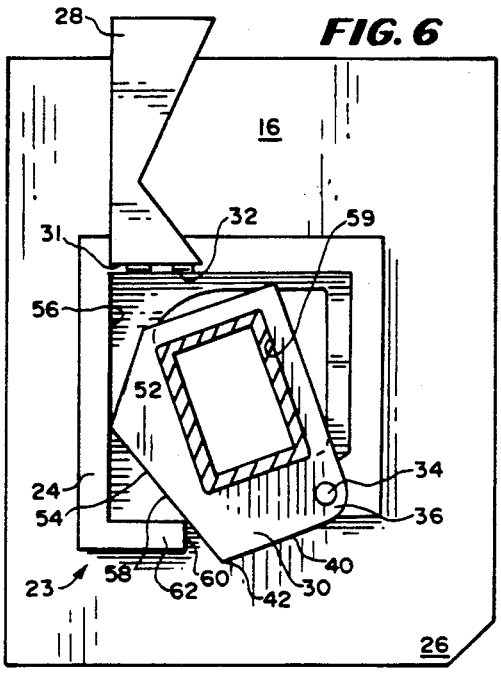
FIG. 6 is a front view of the framework in an unlocked condition thereof.
Figure 7:
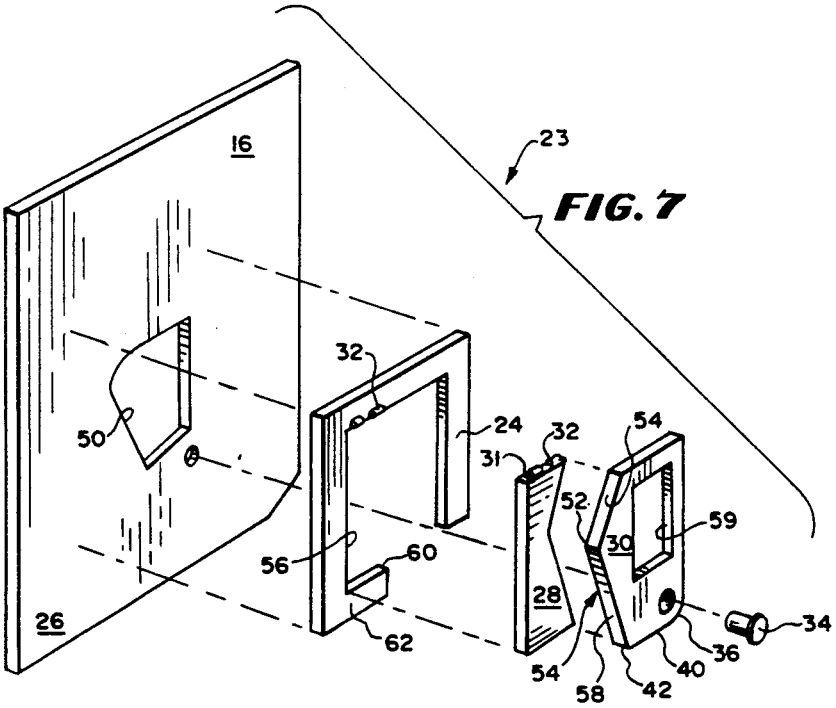
FIG. 7 is an exploded perspective view of the framework and a side wall of the front plow mount.

A first, forward plate 28 is K shaped, is relatively narrow in lateral extent, and is engaged along an upper edge 31 thereof to the peripheral lip 24 by a hinge 32. The plate 28 may be rotated upwardly, out of engagement within the lip 24, about the hinge 32 as shown in FIGS. 2, 4 and 6 and may be locked in this upstanding position in any suitable manner.

With the forward plate 28 disengaged from confinement within the peripheral lip 24, a second, pentagonal plate 30 is released from the upright position in which it was held by the plate 28 and is free to rotate forwardly and rearwardly within limits defined by the shape of the aligned openings 22 in the side walls 16 of the forward plow frame 18, as well as within limits defined by the peripheral lip 24.

The second plate 30 pivots about a bolt 34 which is positioned at a rear lower corner 36 of the plate 30 and which extends through the side wall 16 of the plow frame 18, pivotably engaging the plate 30 thereto.

In order to allow for forward pivotability of the plate 30, the peripheral lip 24 terminates at a point below the first plate 28 and actually only defines about $\frac{7}{8}$ of an approximate square. If the lip 24 were to be extended below the second plate 30, a lower edge 40 of the second plate 30 would abut thereagainst and be kept from pivoting downwardly. Accordingly, with the lip 24 terminating at a point below the first plate 28, ahead of a forward end 42 of the lower edge 40 of the plate 30, the plate 30 is free to pivot about the bolt 34 when the first plate 28 is not seated within the confines of the peripheral lip 24.

The limitation on forward rotation of the plate 30 is produced when three things occur, the design of the framework 10 being such as to cause their simultaneous occurrence.

As the plate 30 rotates forwardly, it will be obvious that the mounting arm 12 extending through an opening 59 therein, as well as the post 13 engaged thereto, will also rotate forwardly. Forward rotation of the arm 12 stops upon abutment of the arm 12 against a forward, slanted edge 50 of the opening 22 in the side wall 16 of the forward plow frame 18.

Further, as the second plate 30 rotates forwardly with the arm 12, a point 52 of a V shaped forward edge 54 thereof abuts against a forward wall 56 of the peripheral lip 24, as best illustrated in FIG. 6.

Still further, as the point 52 abuts the forward wall 56 of the lip 24, a lower inclined forward wall 58 of the second plate 30 is brought to rest upon a terminal edge 60 of a bottom wall 62 of the peripheral lip 24 therebeneath.

This triple abutment, it has been found through empirical testing, eliminates all stress on the pivot point bolt 34 by creating a forward lean or torque rather than a downward pressure, with any remaining downward pressure being taken up by the terminal edge 60 of the peripheral lip 24 where it abuts the inclined lower forward wall 58 of the plate 30. In other words, the vertical weight and twist are supported by the resultant force components produced on the inclined surface of lower forward wall 58.

This support component is also produced when the plates 28 and 30 are contiguously engaged within the lip 24. In this respect, lower inclined forward wall 58 of the second plate 30 is supported by the contiguous wall 62 of first plate 28 when the plates 28 and 30 are locked in engaged position. Also, because of the plates 28 and 30, it has been found that this configuration keeps the plate 28 from becoming jammed within the lip 24 by the plate 30, and assures an easy disengagement of the plate 28 from its position within the plate 24 when such is required.

As described above, the framework 10 of the present invention has a number of advantages some of which have been described above and others of which are inherent in the invention.

Also, modifications can be proposed to the system 10 without departing from the teachings herein.

Accordingly the scope of the invention is only to be limited as necessitated by the accompanying claims.

We claim:

1. A wing plow mounting support framework having a section thereof engaged to each side wall of a forward plow frame, each section being a mirror image of the other and comprising a peripheral lip welded to the side wall and defining a substantially squared area therewithin, the squared area encompassing within the confines thereof, an opening in the side wall through which a mounting arm of the wing plow passes; and two contiguous plates received in side by side fashion within said squared area, a forward one of said plates being K shaped, and engaged to the lip by means of a hinge at one edge thereof, said K shaped plate being pivotable about said hinge to a position exterior of said lip, and a rearward one of said plates being essentially pentagonal in shape and including an opening therein aligned with the opening in the side wall therebehind; said rearward plate being pivotably engaged to the side wall of the forward plow frame by a bolt seated rearwardly and subjacent to said opening in said plate, said plate further covering a major portion of the opening in the side wall of the forward plow frame and being forwardly and rearwardly rotatable about said bolt within the confines of said peripheral lip, a forward point of said pentagonal plate resting against a forward wall of said lip, a point along an inclined lower forward wall of said pentagonal plate resting upon a terminal corner of a lower wall of said peripheral lip and a forward surface of said wing plow mounting arm resting against a forward slanted surface of the opening in the side wall of the forward plow frame, simultaneously, when the pentagonal plate is rotated to a forwardmost position thereof.

2. A wing plow mounting support framework comprising two mirror image sections each of which mounts to a side wall of a forward plow frame, each section including a peripheral lip defining a space within which are contiguously seated first and second plate members, said first plate member being pivotable about a hinge engaging the first plate member to said lip, and being unseated from within said lip upon pivoting about said hinge, and said second plate being engaged to a mounting arm of said wing plow and, when said first section is unseated, being rotatable about a pivot point subjacent the engagement area of the mounting arm in a manner to allow forward pivoting of the mounting arm engaged therethrough.

3. In combination with a forward plow frame including two side walls extending between a forward plow and a vehicle attached thereto, each side wall including an opening therein aligned with the opening in the other for receiving a wing plow mounting arm therethrough, a wing plow mounting support framework comprising two mirror image sections each of which mounts to a side wall of a forward plow frame, each section including a peripheral lip defining a space overlying the opening in the side wall of the forward plow frame within which are contiguously seated first and second plate members, said first plate member being pivotable about a hinge, said first plate member being unseated from within said lip upon pivoting about said hinge, and said second plate member being engaged to a mounting arm of said wing plow and, when said first plate member is unseated, being rotatable about a pivot point subjacent the engagement area of the mounting arm in a manner to allow forward pivoting of the mounting arm engaged therethrough.

4. The combination of claim 3 wherein said first plate is K shaped, narrow in lateral extent, and seats in a forward location within the lip.

5. The combination of claim 4 wherein said second plate is pentagonal, a forward wall of same being comprised of two inclined walls coming to an approximately centered point; the centered point engaging against a forward wall of said peripheral lip and a lower inclined surface coming to rest upon a terminal point of a bottom wall of the peripheral lip when said second plate is at a forwardmost position of rotation.

6. The combination of claim 5 wherein said second plate has an opening therethrough which is sized and configured to receive a wing plow mounting arm snugly therein.

7. The combination of claim 6 wherein said opening in said second plate corresponds in positioning thereof to overlie an opening in the side wall of the front plow mount; the opening in said second plate being sized and configured to allow for pivotability of the wing plow mounting arm engaged to said second plate in a manner where a forward surface of the wing plow mounting arm lies against a forward inclined surface of the opening in the side wall when said second plate is in its forwardmost position.

8. The combination of claim 7 wherein said terminal point of said bottom wall of said peripheral lip is positioned beneath a rear end edge of said first plate.

9. The combination of claim 8 wherein said first plate is a front plate and said second plate is a rear plate.

10. The combination of claim 9 wherein said first plate is hingedly fixed to said peripheral lip.

11. The combination of claim 10 wherein said first plate includes means for locking same in position within the peripheral lip.

12. The combination of claim 11 wherein said first plate includes means for locking same in position outside the peripheral lip.

13. The combination of claim 12 wherein said pivot point for said second plate is formed rearwardly subjacent the opening in said second plate by a bolt extending through said second plate and the side wall of the forward plow frame.

14. A wing plow comprising:

a wing plow mounting support framework including two spaced side walls adapted for attachment of a front plow to the front thereof, mirror image sections attached to the side walls of the framework, a wing plow mounting arm extending through said sections, each section comprising means for engaging the mounting arm of the wing plow to prevent rotational movement about a horizontal pivot axis, and means for releasably securing said engaging means in an upright position when the engaging means is not engaging the mounting arm.

15. The framework of claim 14 wherein each section includes a peripheral lip defining an approximately square opening within which two contiguous plates are engaged in side by side manner.

16. The framework of claim 15 wherein said two contiguous plates comprise a first forward K shaped plate and a second rear pentagonal plate which is locked in place when said first plate is contiguous thereto.

17. The framework of claim 16 wherein said first plate is pivotable about a hinge to a position out of engagement against said second plate and said second plate is forwardly rotatable about a pivot point at a rear lower corner thereof.

18. The framework of claim 17 includes wherein said second plate an opening therein within which a mounting arm of the wing plow is engaged, the opening aligning with an opening in the side wall of the forward plow frame.

19. The framework of claim 18 wherein said second plate pivots forwardly to a position where a center point of a forward surface thereof defined by two inclined walls abuts a forward wall of the peripheral lip and a lower inclined wall abuts a terminal point of a bottom wall of said peripheral lip.

* * * * *